US012667748B1

(12) United States Patent
Dai

(10) Patent No.: US 12,667,748 B1
(45) Date of Patent: Jun. 30, 2026

(54) LOCKING ELEMENT AND FITNESS EQUIPMENT CONFIGURED FOR WEIGHT ADJUSTMENT HAVING THE LOCKING ELEMENT

(71) Applicant: Zhejiang Luxiang Intelligent Technology Co., Ltd., Taizhou (CN)

(72) Inventor: Ze Dai, Taizhou (CN)

(73) Assignee: LOCKING ELEMENT AND FITNESS EQUIPMENT CONFIGURED FOR WEIGHT ADJUSTMENT HAVING THE LOCKIN, Taizhou (CN)

( * ) Notice: Subject to any disclaimer, the term of this patent is extended or adjusted under 35 U.S.C. 154(b) by 0 days.

(21) Appl. No.: 19/260,315

(22) Filed: Jul. 4, 2025

(30) Foreign Application Priority Data

Apr. 10, 2025 (CN) ..... 202520665658.8
May 27, 2025 (CN) ..... 202510693656.4

(51) Int. Cl.
*A63B 21/072* (2006.01)

(52) U.S. Cl.
CPC ..... *A63B 21/0728* (2013.01)

(58) Field of Classification Search
CPC ..... A63B 21/0728; A63B 21/072–0783; F16B 2/16; F16B 7/149; F16B 21/165; F16B 21/10; F16B 2/12; F16B 7/1409; Y10T 403/592; Y10T 403/599; E05B 73/0041
See application file for complete search history.

(56) References Cited

U.S. PATENT DOCUMENTS 2,429,202 A * 10/1947 Estill ..... F16L 37/23 285/277
5,295,934 A * 3/1994 Collins ..... A63B 21/0728 482/107
6,007,268 A * 12/1999 Whittington ..... A63B 21/0728 403/348
6,059,700 A * 5/2000 Ellenburg ..... A63B 21/0724 482/107
11,117,013 B1 * 9/2021 Davies ..... A63B 21/0728
11,781,688 B2 * 10/2023 Williams ..... B25B 27/10 285/321
2022/0362619 A1 * 11/2022 Clifford ..... A63B 21/0728

* cited by examiner

*Primary Examiner* — Megan Anderson
*Assistant Examiner* — Catrina A Letterman
(74) *Attorney, Agent, or Firm* — Birchwood IP

(57) ABSTRACT

A locking element and a fitness equipment with the locking element are provided. The locking element includes an inner cylinder and an outer sleeve cylinder. Both the inner cylinder and the outer sleeve cylinder are provided with conical surfaces, and steel balls are sleeved in a through hole provided on the conical surface of the inner cylinder. An unlocking handle drives the inner cylinder to move axially through the inclined surface to unlock. The fitness equipment includes a handle, main shafts symmetrically rotatably provided on two sides of the handle, a limit block, and a counterweight block sleeved on the main shafts. The counterweight block is positioned on the main shaft through the locking element, front and rear sides of the counterweight block are respectively provided with polygonal protrusions and polygonal recesses. The limit block is matched and fitted with the polygonal recesses on the counterweight block.

11 Claims, 11 Drawing Sheets

LOCKING ELEMENT AND FITNESS EQUIPMENT CONFIGURED FOR WEIGHT ADJUSTMENT HAVING THE LOCKING ELEMENT

CROSS-REFERENCE TO RELATED APPLICATIONS

This application claims priority to Chinese Patent Application No. 202510693656.4, filed on May 27, 2025 and Chinese Patent Application No. 202520665658.8, filed on Apr. 10, 2025. Both of which are hereby incorporated by reference in their entireties.

TECHNICAL FIELD

The present disclosure relates to the field of fitness equipment technologies, and in particular, to a locking element and a fitness equipment configured for weight adjustment having the locking element.

BACKGROUND

With the improvement of people's living standards, more and more people are starting to exercise. Fitness can not only enhance physical fitness, but also shape a muscular physique. Common fitness equipment such as dumbbells or barbells can be used for training to enhance muscle strength and promote body coordination. In order to adapt to the training requirements of different stages, it is necessary to constantly adjust the weight for phased training during the training process, and also switch between using dumbbells or barbells.

However, traditional dumbbells or barbells have the problem of inconvenient weight adjustment, and some dumbbells or barbells that can adjust their weight through counterweight blocks are not suitable for the needs of ordinary consumers due to their complex structure and high production costs. Although some dumbbells or barbells have adjustable counterweight blocks, the adjustment time is long and the difficulty is high, which brings a bad experience for users.

SUMMARY

The purpose of the present disclosure is to provide a locking element with low production cost and convenient and fast adjustment, as well as a fitness equipment configured for weight adjustment having the locking element.

The purpose of the present disclosure is to solve it as follows.

A locking element, where the locking element includes an inner cylinder with an axial through-hole and an outer sleeve cylinder sleeved outside the inner cylinder, an outer side wall of the inner cylinder has a first conical surface, an inner wall of the outer sleeve cylinder is provided with a second conical surface that matches with the first conical surface, an outer side wall of the inner cylinder on a large-diameter side of the first conical surface is provided with an inclined surface, a top transverse groove of the outer sleeve cylinder is provided with an unlocking button that drives the inclined surface to move axially, the first conical surface of the inner cylinder is sleeved with steel balls in first through holes provided at intervals in a circumferential direction; an end face of the outer sleeve cylinder on a recess side is connected to an annular cover plate, and the cover plate is connected to the top transverse groove of the outer sleeve cylinder; a spring is provided between the cover plate and the inner cylinder to drive the inner cylinder to move away from the cover plate; two ends of the spring are respectively connected to spring seats on the cover plate and the inner cylinder; or the locking element includes an inner cylinder with a central through hole, and an outer side of the inner cylinder is sleeved with an outer sleeve cylinder; one side of the outer side wall of the inner cylinder has a conical surface with a small head facing outward, and another side of the outer side of the inner cylinder is extended out of the outer sleeve cylinder through connection arms that are provided at intervals and is provided with a pull-and-push ring; one side of an inner wall of the outer sleeve cylinder has an inner wall surface that matches with the conical surface, and the other side of the inner wall of the outer sleeve cylinder is fixedly connected to a clamp slot of the annular cover plate through a connection rod passing through a strip-shaped hole between adjacent connection arms on the inner cylinder; steel balls are provided in through holes provided at intervals in a circumferential direction on the conical surface of the inner cylinder; a gap configured for the inner cylinder to move is provided between the cover plate and an end face of the inner cylinder; a spring is provided in a gap provided between the inner cylinder and the cover plate to drive the inner cylinder to move towards one side of the conical surface; the pull-and-push ring drives the inner cylinder to move axially, which in turn drives the steel balls to move both axially and radially to achieve locking or unlocking.

In some embodiments of the present disclosure, an upper surface of the unlocking button is provided with one or more protrusions, a lower surface of the cover plate is provided with a guide groove that allows the protrusion to move laterally; the unlocking button is provided with an inclined driving surface that drives the inclined surface to move axially to unlock; the unlocking button has two U-shaped bodies, and the two unlocking buttons are symmetrically provided in four transverse recesses at a top of the outer sleeve cylinder; the inclined driving surfaces are provided at ends of the two side walls of the U-shaped body, and corresponding inclined surfaces on the outer side wall of the inner cylinder also have four inclined surfaces so as to work with the inclined driving surface.

In some embodiments of the present disclosure, a conical groove matching the first conical surface is provided on an inner wall of the outer sleeve cylinder, a conical ring is provided in the conical groove; an inner wall surface of the conical ring has a second conical surface; the first through hole on the inner cylinder is shrined near an inner surface of the inner cylinder, so that an inner diameter of the first through hole is smaller than outer diameters of the steel balls, and the steel balls move radially out of the first through hole and do not leak into an axial through hole of the inner cylinder.

In some embodiments of the present disclosure, an axial groove is provided on the first conical surface between adjacent first through holes on the inner cylinder, and a hollow hole penetrating the side wall of the inner cylinder is provided on the first conical surface on an upper side of the first through hole.

In some embodiments of the present disclosure, an outer wall of a cylindrical body formed by shrinking of an upper outer wall of the inner cylinder is provided with two or more guide grooves, and an inner wall of the cover plate is provided with a guide block that sleeved into the guide groove and cooperates with an axial movement of the inner cylinder.

In some embodiments of the present disclosure, an annular groove is provided on an upper surface of the cover plate; bolt mounting holes are spaced apart in a circumferential direction around the annular groove; the cover plate is screwed into the threaded holes on the outer sleeve cylinder through the bolt mounting holes.

A fitness equipment configured for weight adjustment having the locking element, including a handle, main shafts symmetrically provided on two sides of the handle, and a counterweight block sleeved on the main shafts; where limit blocks are fixedly provided on two sides of the handle through the main shafts, and the counterweight block is provided with a polygonal convex block on a front of the polygonal body and a polygonal recess on a back of the polygonal body; the polygonal convex block on one counterweight block is matched and fitted with the polygonal recess on another counterweight block; the limit block is matched and sleeved with the polygonal recess; a center of the polygonal body is provided with a shaft hole that passes through the polygonal body and the polygonal convex block; a locking element is provided on an outer side of an outermost counterweight block on the main shafts, which restricts an axial movement of the counterweight block.

In some embodiments of the present disclosure, a central hole is provided on the handle; two ends of the central hole are fixedly provided with nuts with a cross-sectional outer contour of polygonal; one end of the nut is extended from an end face of the handle, and an external thread is provided on one end of a neck part of the main shafts; the polygonal hole of the limit block is sleeved with the nuts, screwed onto the nuts on the main shafts, and pressed onto the handle.

In some embodiments of the present disclosure, the counterweight block has three equal parts in an axial direction, a middle of the counterweight block occupies one equal part of the counterweight block, the polygonal convex block occupies one equal part of one side of the counterweight block, and the polygonal recess occupies one equal part of the other side of the counterweight block.

In some embodiments of the present disclosure, the three equal parts of the counterweight block are separate structures, which are connected as a whole through welding or bonding; or the three equal parts of the counterweight block form an integrated structure.

In some embodiments of the present disclosure, a drum shaped protrusion or an anti-slip protrusion is provided in a middle of the handle.

In some embodiments of the present disclosure, the polygonal convex block or polygonal recess is provided at any position of the counterweight block.

The positive effects of the present disclosure compared to the prior art are as follows.

1. The counterweight block of the present disclosure is provided with a polygonal convex block and a polygonal recess, which facilitate quick positioning using the polygonal convex block on one counterweight block and the polygonal recess on another counterweight block, rendering quick disassembly and assembly and saving time.
2. The present disclosure utilizes polygonal nuts and main shaft limit blocks to be positioned on the handle, and the weight of the counterweight block is sequentially transmitted to the limit block and handle through polygonal protrusions and polygonal recess. The weight borne by the main shaft is relatively small, and there is no possibility of the counterweight block injuring people or objects due to main shaft fracture. Therefore, the main shaft can also be made thinner and is only used to lock the counterweight block with the locking element.
3. The locking element of the present disclosure can be quickly positioned on the main shaft to fix the counterweight, with simple and fast operation.
4. The structure of the present disclosure is simple, the production cost is low, the use is convenient, the failure rate is low, the service life is long, and it is easy to promote and use in the field of dumbbells or barbells.

DESCRIPTION OF EMBODIMENTS

Figure 1:
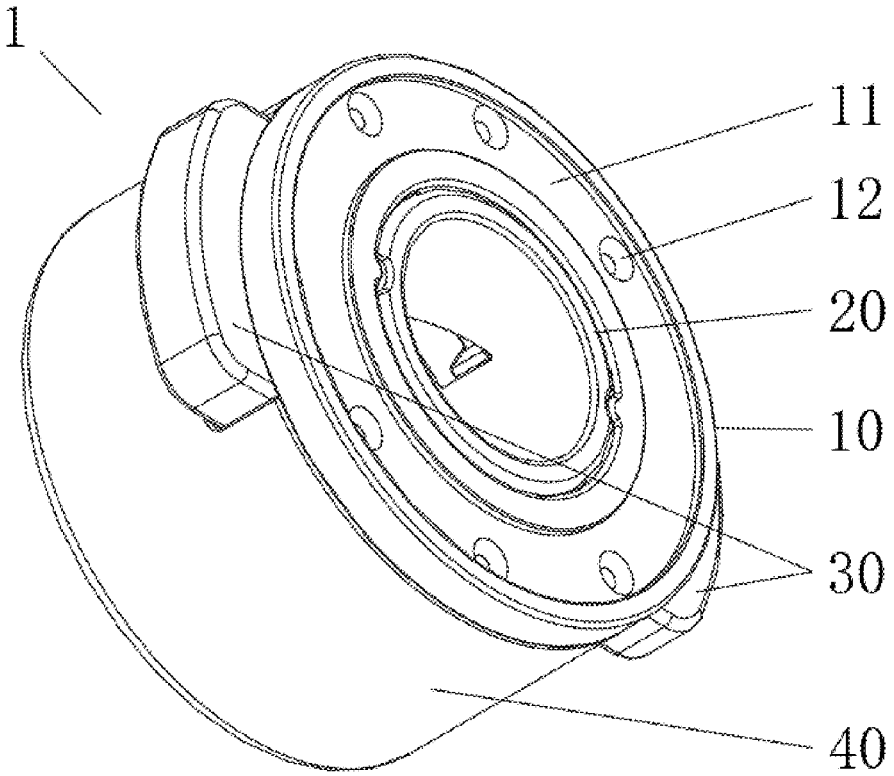
FIG. 1 is a first three-dimensional schematic diagram of one locking element of the present disclosure.
Figure 2:
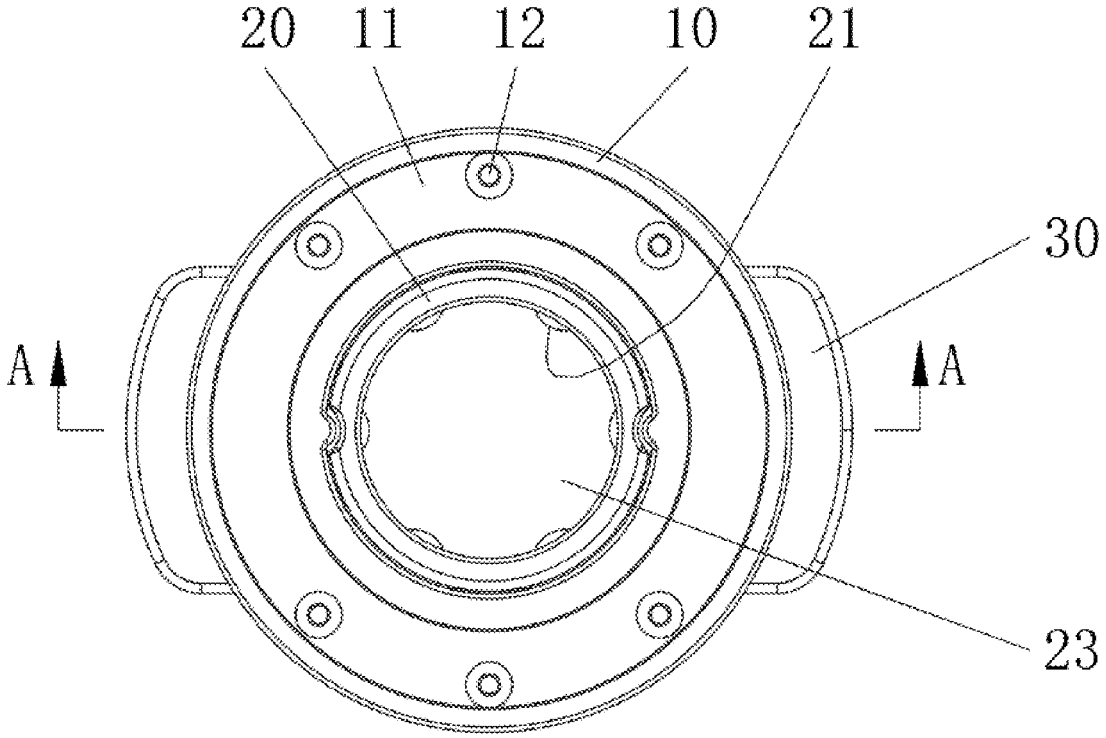
FIG. 2 is a first front view of one locking element of the present disclosure.
Figure 3:
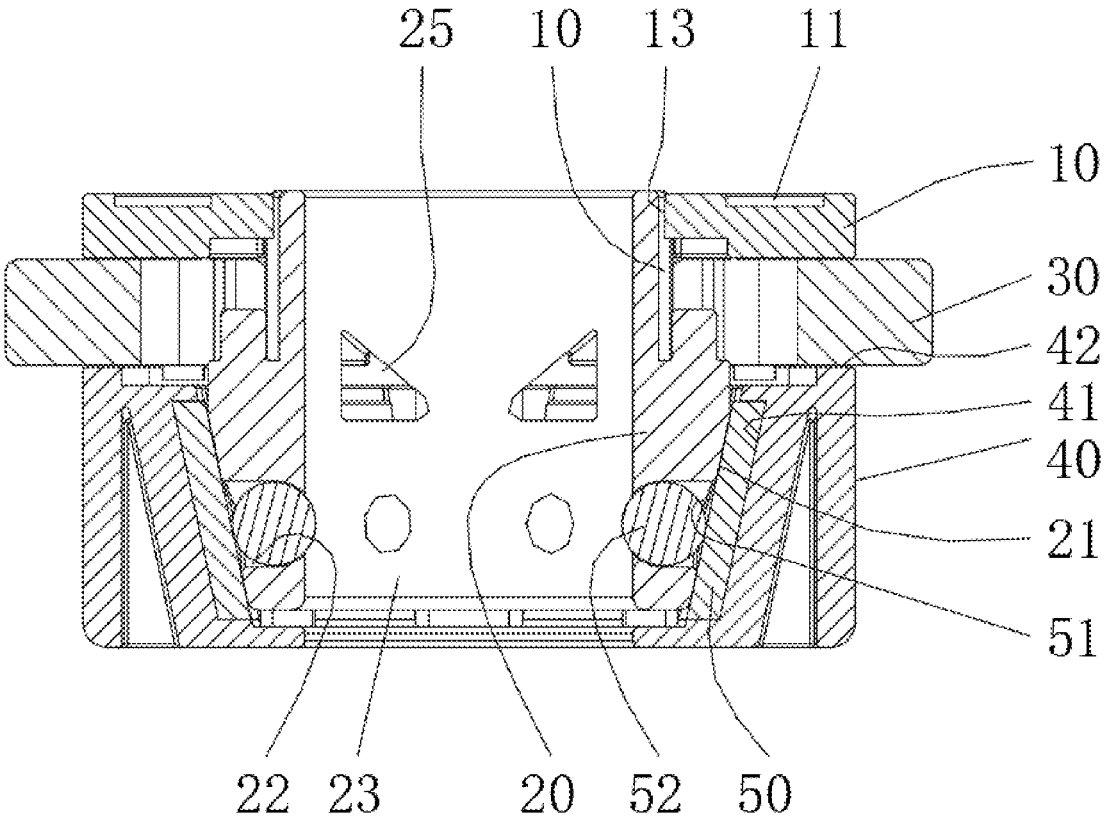
FIG. 3 is a cross-sectional view taken along line A-A of FIG. 2.
Figure 4:
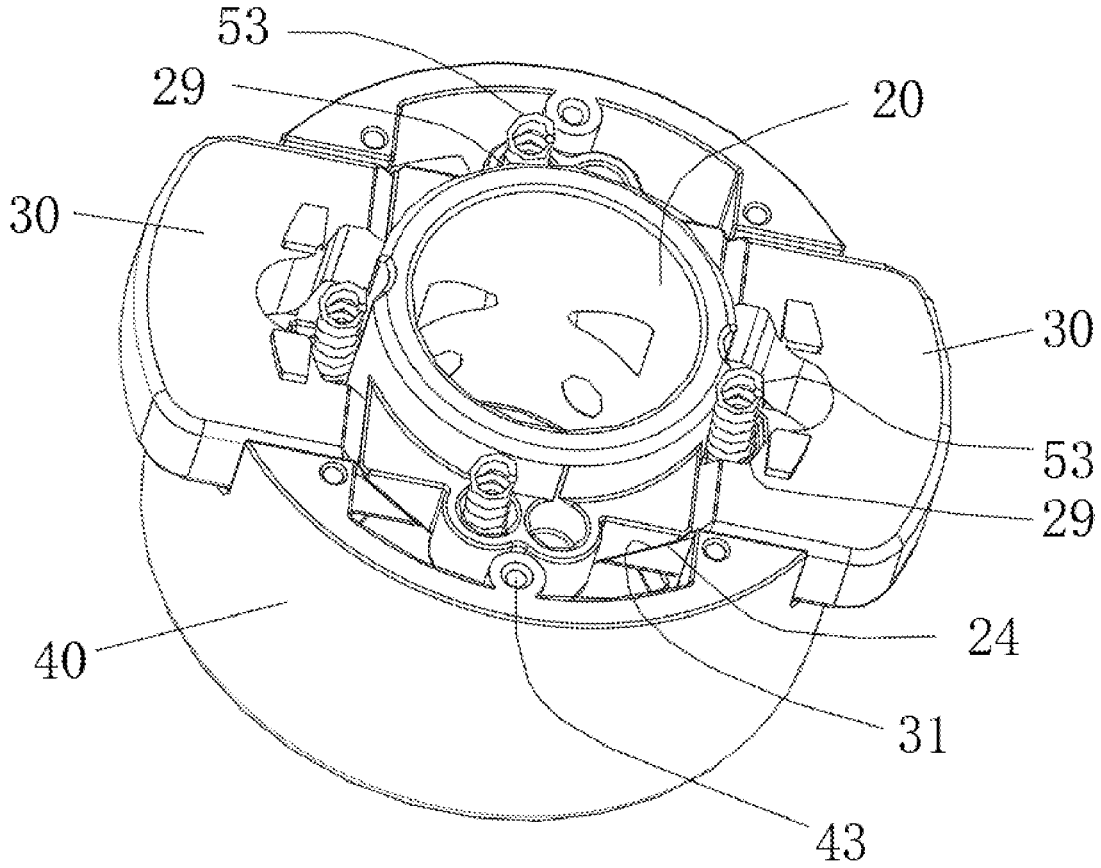
FIG. 4 is a three-dimensional schematic diagram of one locking element of the present disclosure after removing a cover plate.
Figure 5:
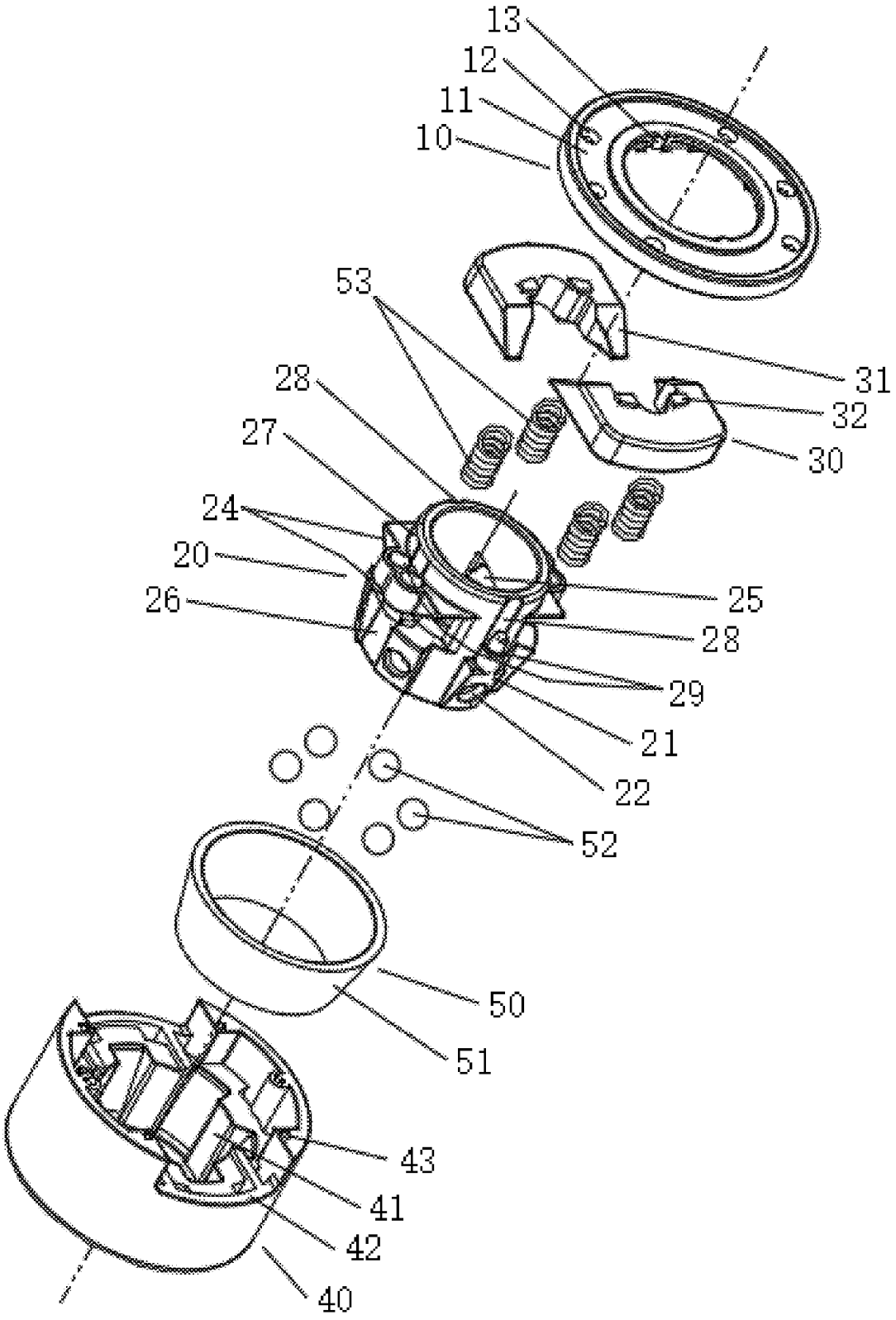
FIG. 5 is an exploded schematic diagram of one locking element of the present disclosure.
Figure 6:
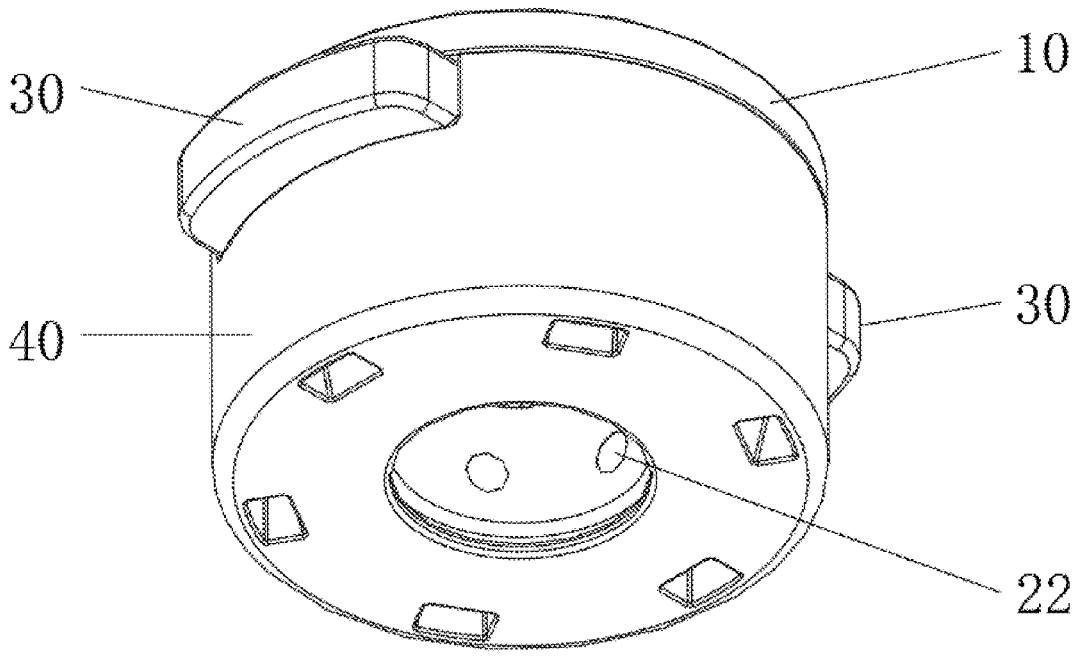
FIG. 6 is a second three-dimensional schematic diagram of one locking element of the present disclosure.
Figure 7:
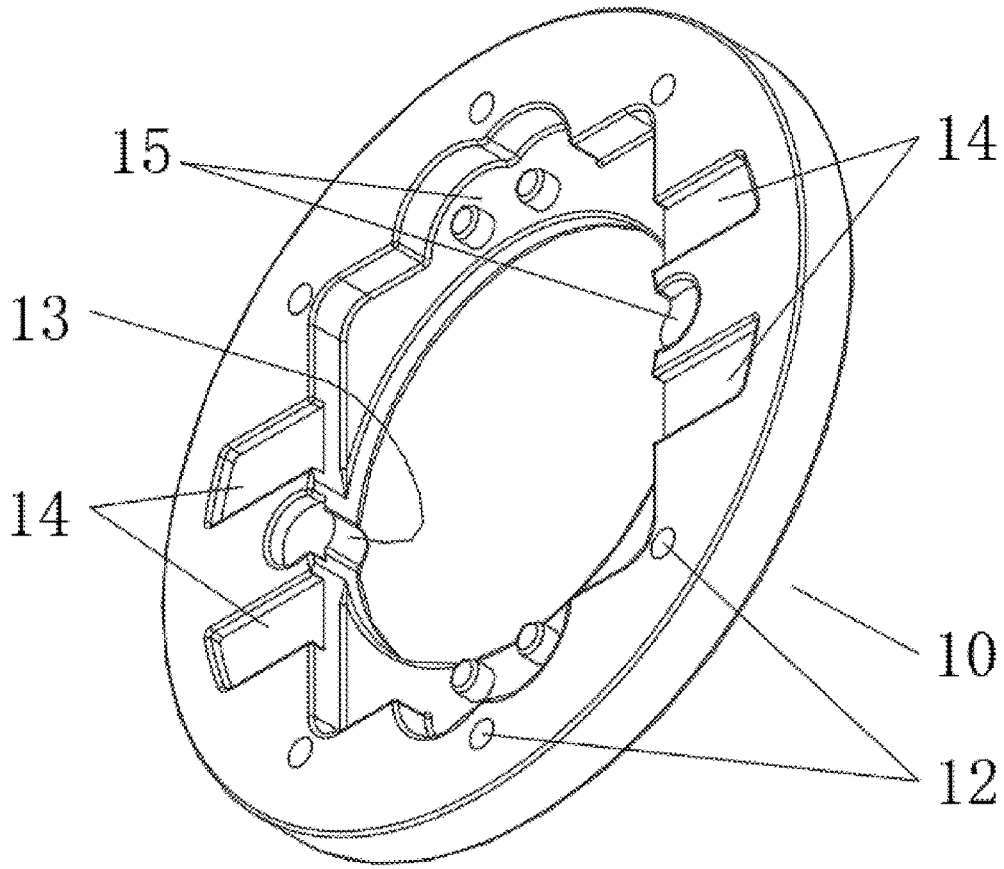
FIG. 7 is a three-dimensional schematic diagram of the cover plate of one locking element of the present disclosure.
Figure 8:
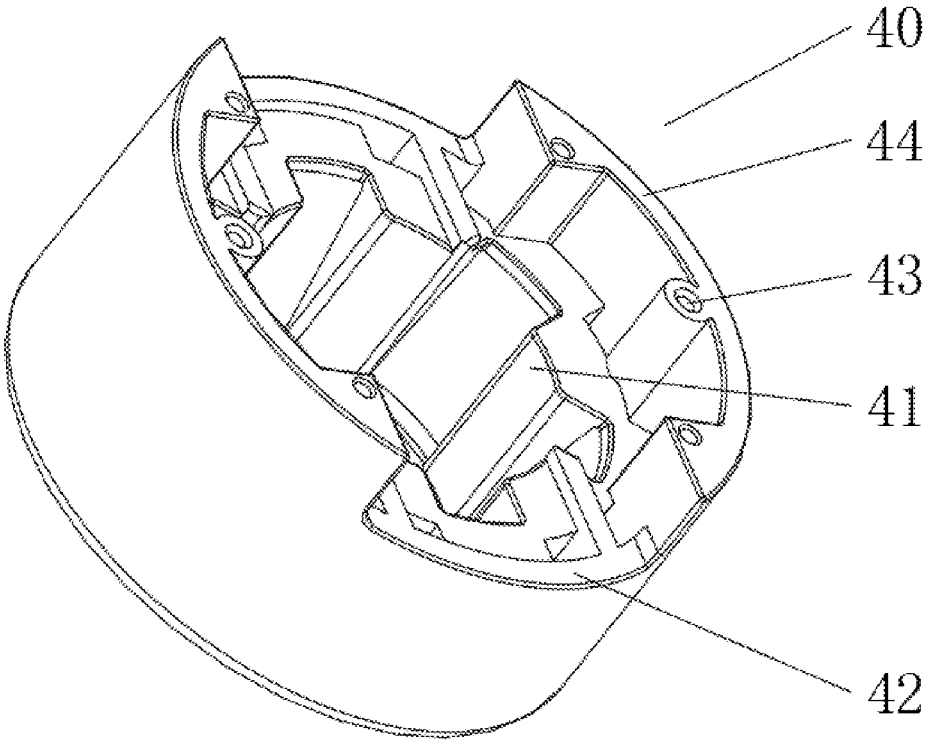
FIG. 8 is a three-dimensional schematic diagram of an outer sleeve cylinder of one locking element of the present disclosure.
Figure 9:
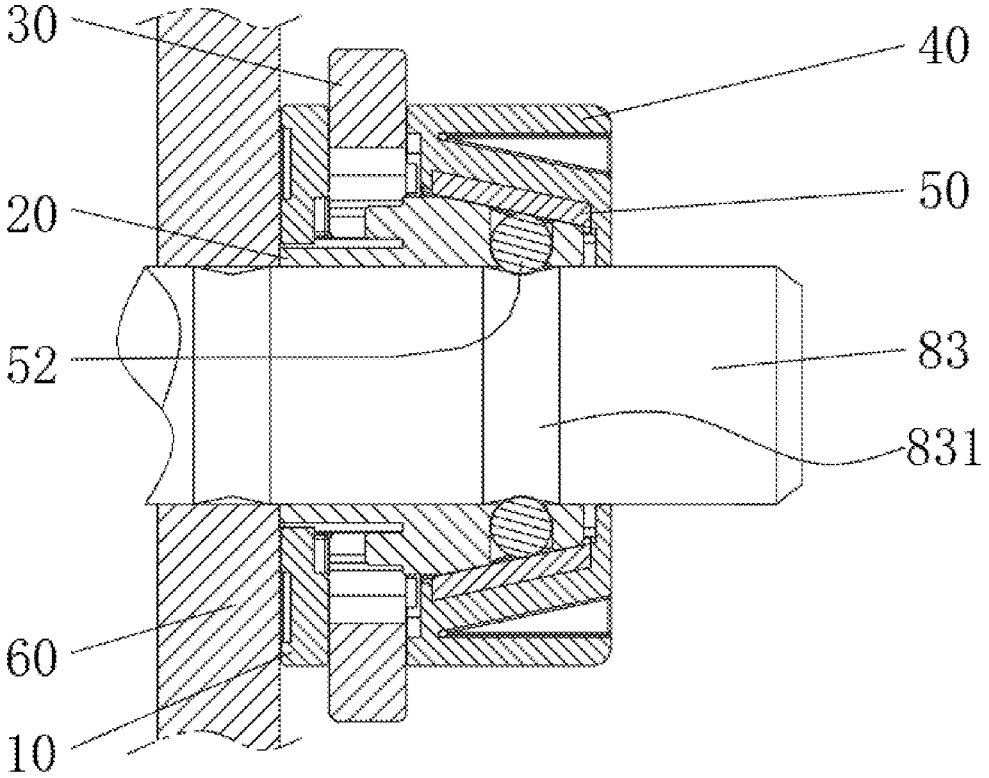
FIG. 9 is a schematic sectional view of one locking element of the present disclosure installed on a main shaft.
Figure 10:
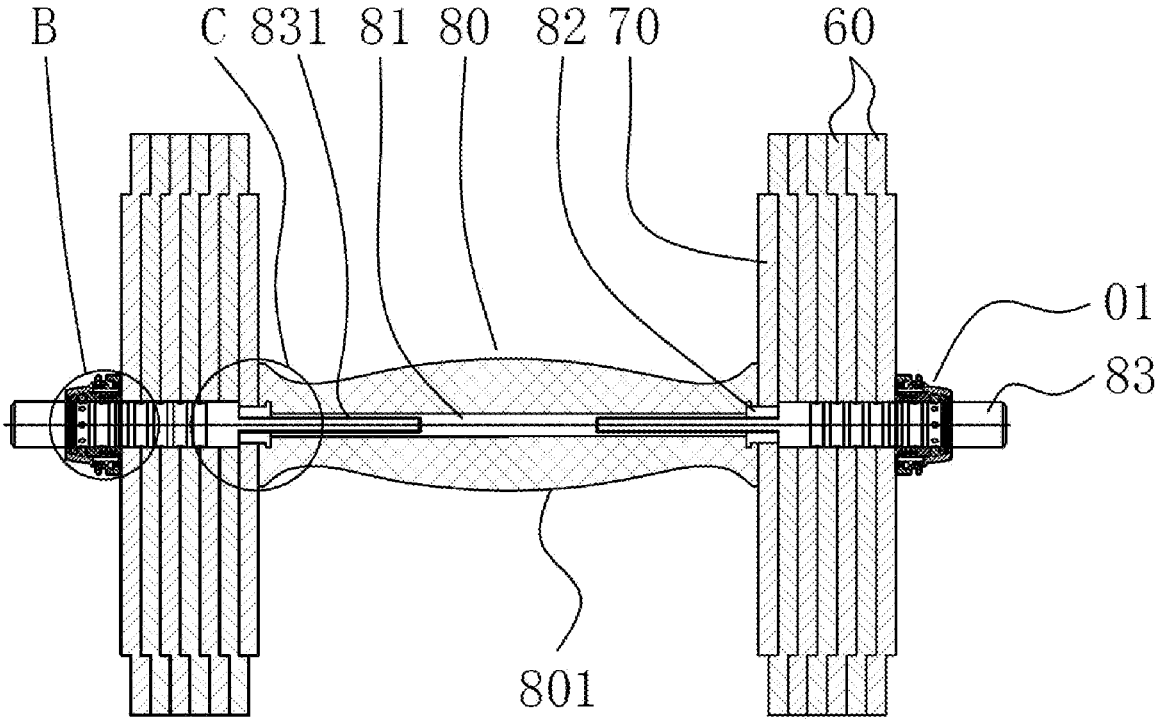
FIG. 10 is a sectional view of the present disclosure.
Figure 11:
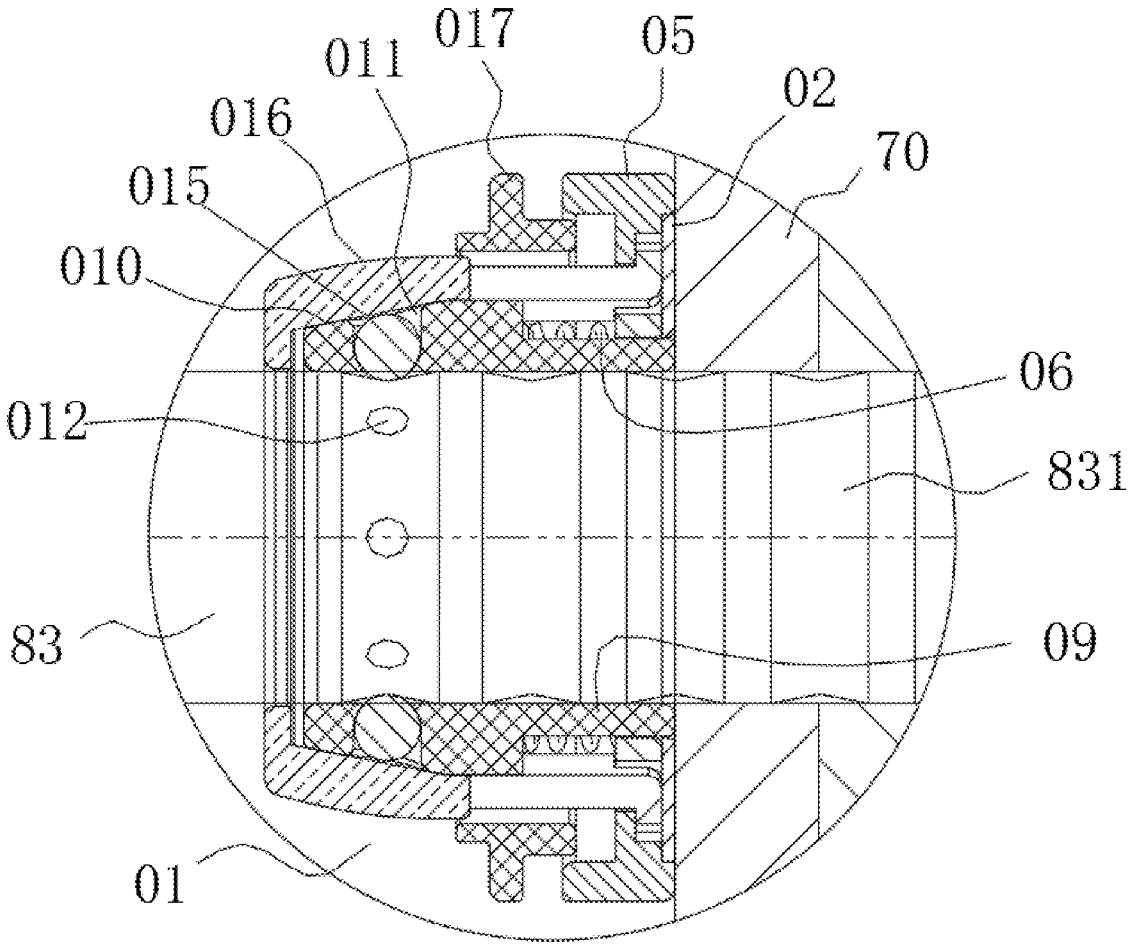
FIG. 11 is an enlarged view of part B in FIG. 10.
Figure 12:
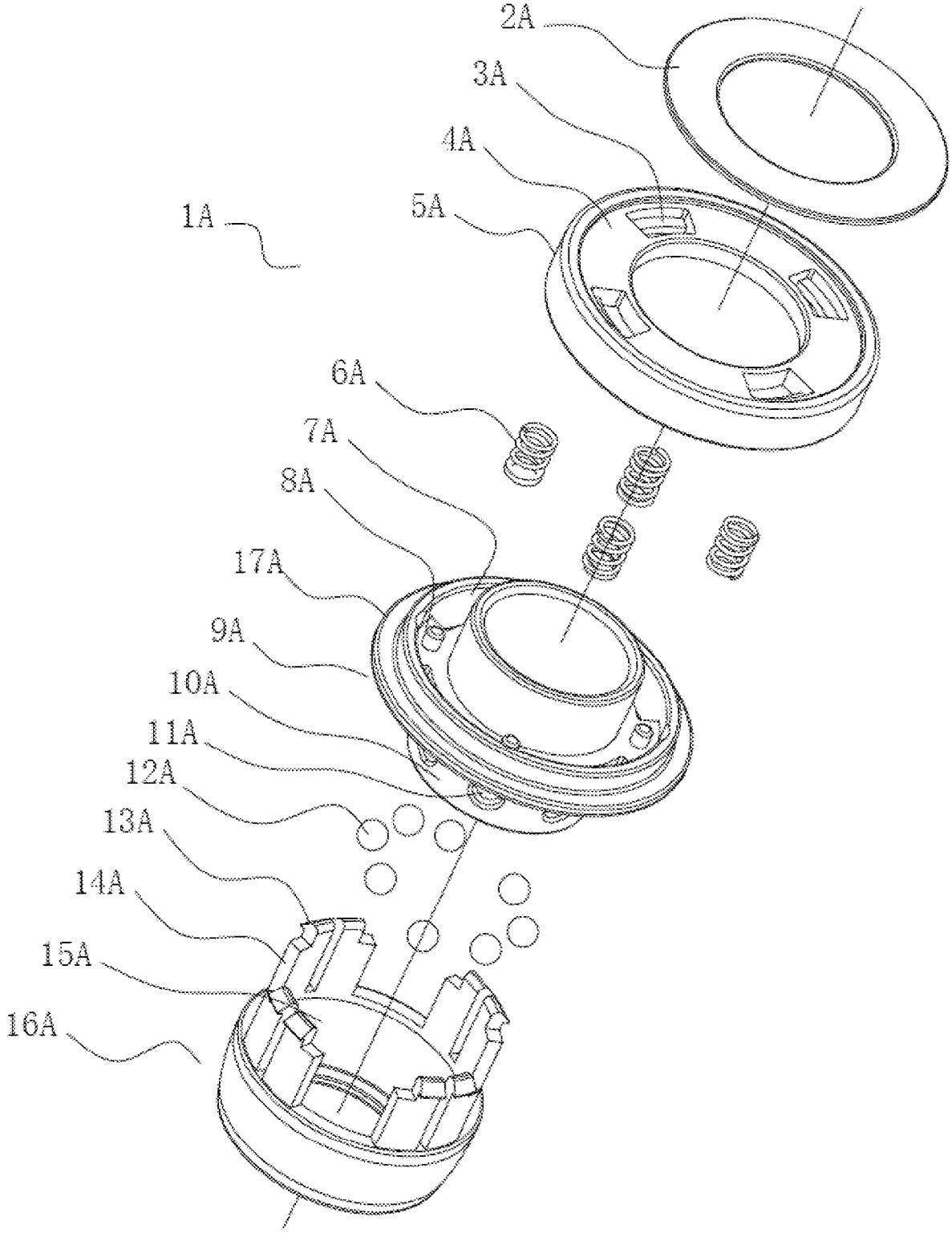
FIG. 12 is an exploded schematic diagram of a second locking element of the present disclosure.
Figure 13:
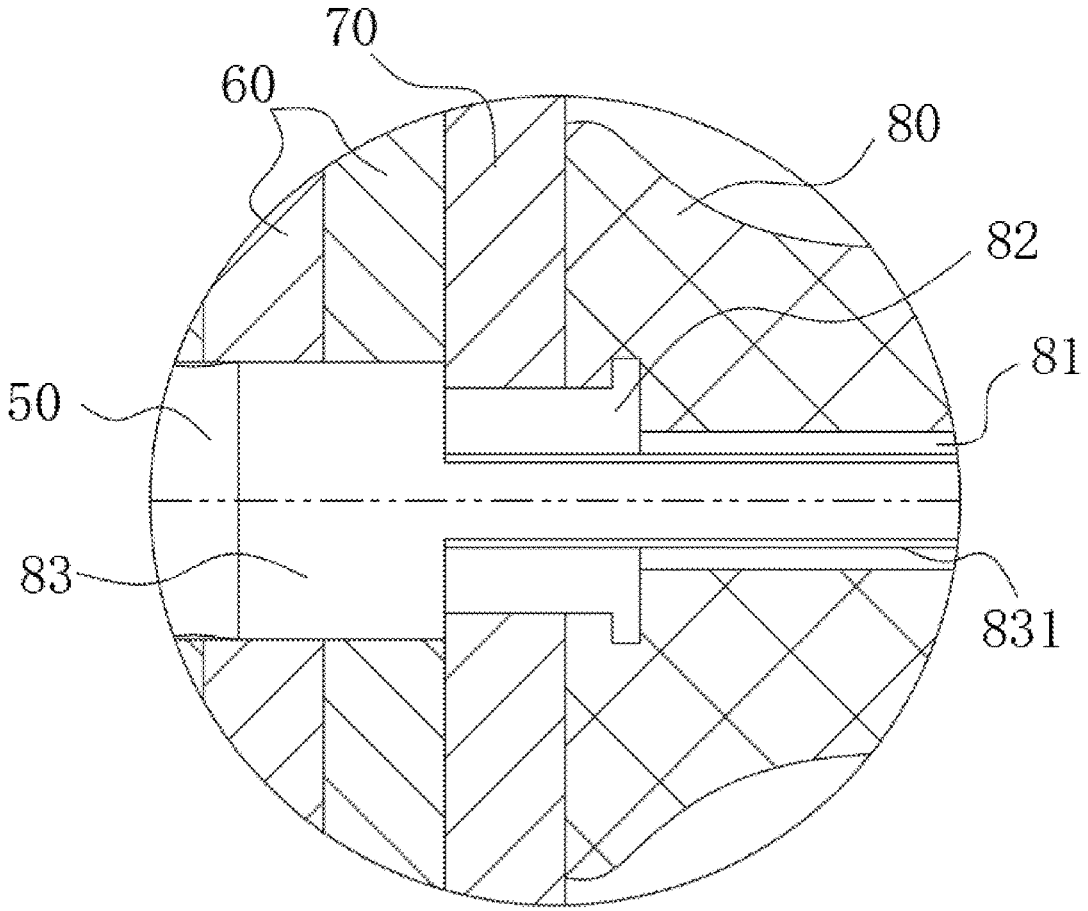
FIG. 13 is an enlarged view of part C of FIG. 10.
Figure 14:
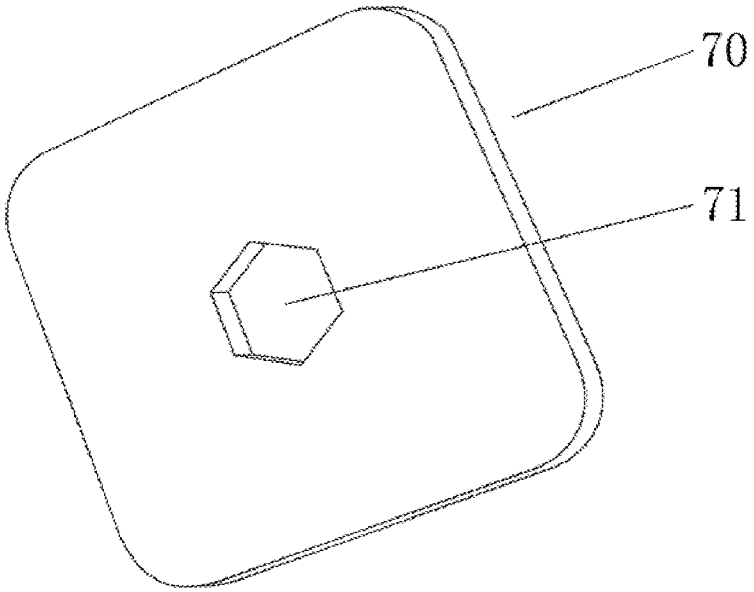
FIG. 14 is a three-dimensional schematic diagram of a polygonal convex block of a counterweight block of the present disclosure facing forward.
Figure 15:
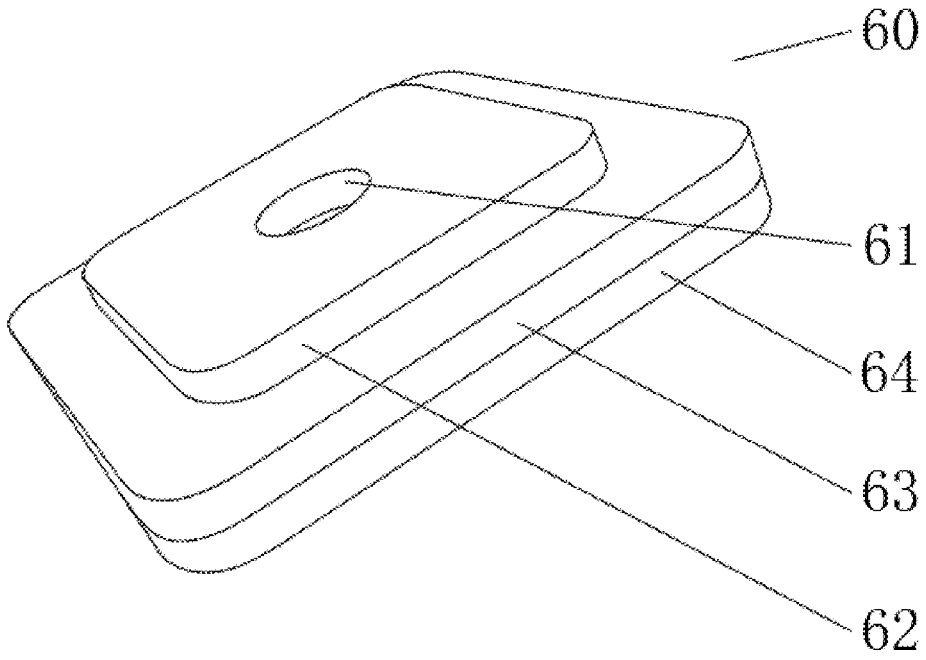
FIG. 15 is a three-dimensional schematic diagram of a polygonal recess of the counterweight block of the present disclosure facing forward.
Figure 16:
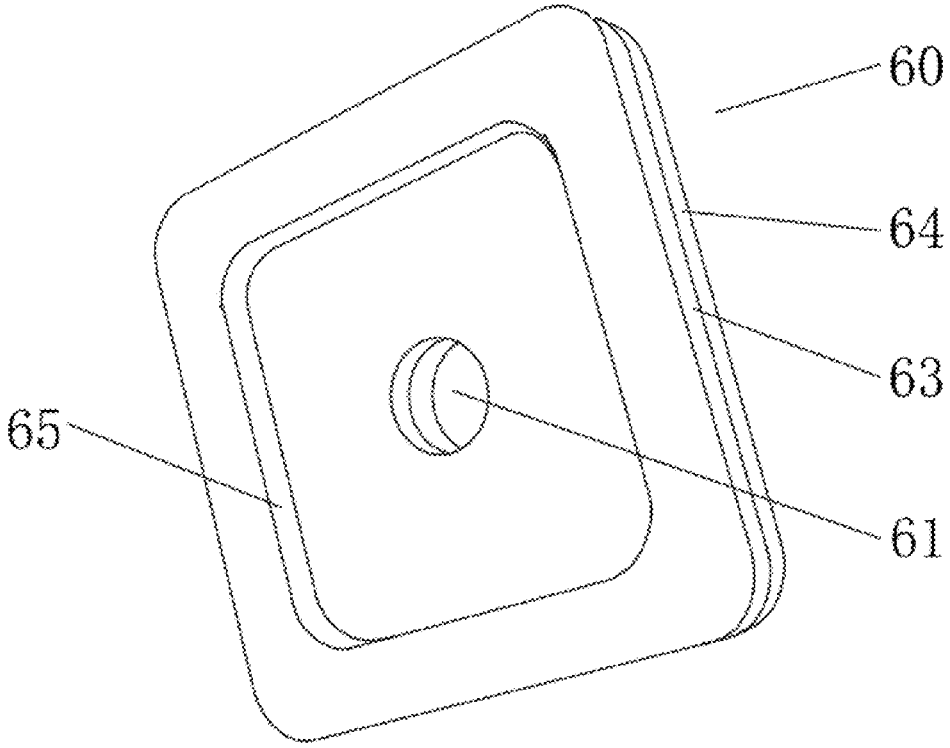
FIG. 16 is a three-dimensional schematic diagram of a limit block of the present disclosure.

The present disclosure will be further described with specific embodiments in combination with the accompanying drawings, as shown in FIGS. 1-16.

A locking element includes an inner cylinder 20 with an axial through hole 23 and an outer sleeve cylinder 40 sleeved outside the inner cylinder 20. An outer side wall of the inner cylinder 20 has a first conical surface 21, an inner wall of the outer sleeve cylinder 40 is provided with a second conical surface 51 that matches the first conical surface 21. An outer side wall of the inner cylinder 20 on a large-diameter side of the first conical surface 21 is provided with an inclined surface 24, a top transverse groove 42 of the outer sleeve cylinder 40 is provided with an unlocking button 30 that drives the inclined surface 24 to move axially. Steel balls 52 are sleeved into first through holes 22 spaced apart in a circumferential direction on the first conical surface 21 of the inner cylinder 20. An end face 44 of the outer sleeve cylinder 40 at the top transverse groove 42 side is provided with an annular cover plate 10, and a spring 53 is provided between the cover plate 10 and the inner cylinder 20 to drive the inner cylinder 20 to move away from the cover plate 10. Two ends of the spring 53 are respectively connected to spring seats 15 and 29 on the cover plate 10 and the inner cylinder 20. The cover plate 10 allows the unlocking button 30 to move radially to drive an axial movement of the inner cylinder 20 to unlock.

In an implementation mode, an upper surface of the unlocking button 30 is provided with one or more protrusions 32, a lower surface of the cover plate 10 is provided with a guide groove 14 that allows the protrusions 32 to move laterally.

In an implementation mode, the unlocking button 30 is provided with an inclined driving surface 31 that drives the inclined surface 24 to move axially to unlock.

In an implementation mode, the unlocking button 30 has two U-shaped bodies, and the two unlocking buttons 30 are symmetrically provided in four transverse grooves 42 at a top of the outer sleeve cylinder 40. The inclined driving surfaces 31 are provided at ends of the two side walls of the U-shaped body, and corresponding inclined surface on the outer side wall of the inner cylinder 20 also have four inclined surfaces 24 so as to work with the inclined driving surface 31.

In an implementation mode, a conical groove 41 matching the first conical surface 21 is provided on an inner wall of the outer sleeve cylinder 40, and a conical ring 50 is provided inside the conical groove 41. An inner wall surface of the conical ring 50 has the second conical surface 51.

In an implementation mode, the first through holes 22 on the inner cylinder 20 is shrined near an inner surface of the inner cylinder 20, so that an inner diameter of this area is smaller than outer diameters of the steel balls 52, in order to facilitate a radial movement of the steel ball 52 in the first through holes 22 without leaking into the axial through hole 23 of the inner cylinder 20.

In an implementation mode, an axial groove 26 is provided on the first conical surface 21 between adjacent first through holes 22 on the inner cylinder 20.

In an implementation mode, a hollow hole 25 penetrating the side wall of the inner cylinder 20 is provided on the first conical surface 21 on an upper side of the first through holes 22.

In an implementation mode, an outer wall of a cylindrical body 27 formed by shrinking of an upper outer wall of the inner cylinder 20 is provided with two or more guide grooves 28, and an inner wall of the cover plate 10 is provided with a guide block 13 that sleeved into the guide grooves 28 and cooperates with an axial movement of the inner cylinder 20.

In an implementation mode, an annular groove 11 is provided on an upper surface of the cover plate 10, and bolt mounting holes 12 are spaced apart in a circumferential direction around the annular groove 11. The cover plate 10 is screwed into threaded hole 43 on the outer sleeve cylinder 40 through the bolt mounting holes 12 by bolts.

The locking element can also adopt the following structure. The locking element 1A includes an inner cylinder 9A with a central through hole, and an outer side of the inner cylinder 9A is sleeved with an outer sleeve cylinder 16A. One side of the outer side wall of the inner cylinder 9A has a conical surface 10A with a small head facing outward, and another side of the inner cylinder 9A is extended out of the outer sleeve cylinder 16A through connection arms 8A that are provided at intervals and is provided with a pull-and-push ring 17A. One side of an inner wall of the outer sleeve cylinder 16A has an inner wall surface 15A that matches the conical surface 10A, and the other side of the inner wall of the outer sleeve cylinder is fixedly connected to a clamp slot 3A of the annular cover plate 5A through connection rod passing through a strip-shaped hole 7A between adjacent connection arms 8A on the inner cylinder 9A. The conical surface 10A of the inner cylinder 9A is arranged at intervals in the circumferential direction. Steel balls 12A are sleeved in through holes 11A, a gap configured for the inner cylinder 9A to move is provided between the cover plate 5A and an end face of the inner cylinder 9A; a spring 6A is provided in a gap between the inner cylinder 9A and the cover plate 5A to drive the inner cylinder 9A to move towards one side of the conical surface 10A. The pull-and-push ring 17A drives the inner cylinder 9A to move axially, which in turn drives the steel balls 52 to move both axially and radially to achieve locking or unlocking. An annular cover plate 2A is provided in the annular groove 4A on a top surface of the cover plate 5A.

A fitness equipment configured for weight adjustment having the locking element 1 or 1A, including a handle 80, main shafts 83 symmetrically provided on two sides of the handle 80, and a counterweight block 60 sleeved on the main shafts 83. Two sides of the handle 80 are fixedly provided with a limit block 70 through the main shafts 83. The counterweight block 60 is provided with a polygonal protrusion 62 on a front of the polygonal body and a polygonal recess 65 on a back of the polygonal body. The polygonal protrusion 62 on one counterweight block 60 can be matched and sleeved with the polygonal recess 65 on another counterweight block 60, and the limit block 70 can be matched and sleeved with the polygonal recess 65. A center of the polygonal body is provided with a shaft hole 61 penetrating the polygonal body and polygonal protrusion 62, and an outermost counterweight block 60 on the main shafts 83 is provided with the locking element 1 or 2 that restricts the axial movement of the counterweight block 60.

In an implementation mode, the handle 80 is provided with a central hole 81, and two ends of the central hole 81 are fixedly provided with nuts 82 with a cross-sectional outer contour of polygonal. One end of the nuts 82 are extended from an end face of the handle 80, and an external thread 831 is provided on a neck part of one end of the main shafts 83. The polygonal hole of the limit block 70 is matched with the nuts 82, screwed onto the nuts 82 on the main shafts 83, and pressed onto the handle 80.

In an implementation mode, the handle 80 is provided with a drum shaped protrusion 801 or anti-slip protrusion in a middle.

In an implementation mode, the counterweight block 60 has three equal parts in an axial direction. A middle of the counterweight block 60 occupies one equal part 63 of the counterweight block 60, the polygonal protrusion 62 occupies one equal part on one side of the counterweight block 60, and the polygonal recess 65 occupies one equal part 64 on the other side of the counterweight block 60.

In an implementation mode, the three equal parts 62, 63, and 64 of the counterweight block 60 are separate structures that are connected as a whole through welding or bonding.

In an implementation mode, the three equal parts 62, 63, and 64 of the counterweight block 60 are integrated structures.

In an implementation mode, the polygonal convex block 62 or polygonal recess 65 can be arranged at any position of the counterweight block 60.

The use of the present disclosure:

1. A use method of a second locking element in the present disclosure (see FIGS. 10-11).

1. Unlocking: the cover plate 5A is pushed towards one side of the pull-and-push ring 17A, and the cover plate 5A drives the outer sleeve cylinder 16A to move axially, which in turn drives the steel balls 12A to move radially outward to achieve unlocking.
2. Locking: after unlocking, the locking element 1A is removed and the number of the counterweight block 60 is adjusted. Then, the locking element 1A is sleeved onto the main shafts 83, the pull-and-push ring 17A is pulled towards the cover plate 5A side and maintain this state. Then, the locking element 1A is inward until it is close to the outermost counterweight block 60, the pull-and-push ring 17A is released, and under an action of the spring 6A, the inner cylinder 9A is moved towards the conical surface 10A side. At the same time, under the action of the inner wall surface 15A of the outer sleeve cylinder 16A, the steel balls 12A are pushed radially inward until it is locked in the annular locking groove 831 of the main shafts 83 to limit the axial movement of the counterweight block 60.

2. A use method of a first locking element in the present disclosure (see FIGS. 1-9).

1. Locking: the unlocking button 30 is pressed to unlock, the cover plate 10 of the locking element 1 is sleeved onto the main shaft 83 and the outer sleeve cylinder 40 is pushed inward. When a front end of the inner cylinder 9A is pressed against a positioned part 71 on the main shaft 83, the outer sleeve cylinder 40 drives the conical ring 50 to move left (in a direction shown in FIG. 9). After releasing the unlocking button 30 is released, under an action of a spring force of the spring 53, the conical ring 50 presses the steel balls 52 radially towards the axis side. The outer sleeve cylinder 40 and the inner cylinder 9A move relative to each other to push the steel balls 52 out, and the positioned part 71 can be fixed or locked on the annular lock groove 831 of the main shafts 83.
2. Unlock: in a locked state, the unlocking button 30 is pressed. The unlocking button 30 drives the inner cylinder 9A to move axially relative to the outer sleeve cylinder 20, overcoming the elastic force of the spring 53. The steel balls 52 are compressed radially outward by the main shafts 83 and moved radially outward in the first through holes 22. The steel balls 52 no longer exerts force on the main shafts 83, and the unlocking button 30 can be pushed axially to the right to drive the inner cylinder 9A to move to the right (in the direction shown in FIG. 9) for unlocking.

The above embodiments are only used to illustrate the technical solution of the present disclosure and not to limit it. Although the present disclosure has been described in detail with reference to the aforementioned embodiments, those skilled in the art should understand that similar simple substitutions or modifications can still be made to the technical solutions or features described in the aforementioned embodiments, and these simple substitutions or modifications do not depart from the spirit and essence of the corresponding technical solutions of the present disclosure, and are still within the protection scope of the present disclosure.

What is claimed is:

1. A locking element, wherein the locking element comprises an inner cylinder with an axial through-hole and an outer sleeve cylinder sleeved outside the inner cylinder, an outer side wall of the inner cylinder has a first conical surface, an inner wall of the outer sleeve cylinder is provided with a second conical surface that matches with the first conical surface, the outer side wall of the inner cylinder on a large-diameter side of the first conical surface is provided with inclined surfaces, a top transverse groove of the outer sleeve cylinder is provided with an unlocking button that drives the inclined surfaces to move axially, the first conical surface of the inner cylinder is sleeved with steel balls in first through holes provided at intervals in a circumferential direction;

an end face of the outer sleeve cylinder on a recess side is connected to an annular cover plate, and the annular cover plate is connected to the top transverse groove of the outer sleeve cylinder;

a spring is provided between the annular cover plate and the inner cylinder to drive the inner cylinder to move away from the annular cover plate;

two ends of the spring are respectively connected to spring seats on the annular cover plate and the inner cylinder.

2. A fitness equipment configured for weight adjustment having the locking element according to claim 1, comprising a handle, main shafts symmetrically provided on two sides of the handle, and counterweight blocks sleeved on the main shafts;

wherein limit blocks are fixedly provided on the two sides of the handle through the main shafts, and the counterweight blocks are provided with a polygonal convex block on a front of a polygonal body and a polygonal recess on a back of the polygonal body;

wherein the polygonal convex block is matched and fitted with the polygonal recess;

the limit blocks are matched and sleeved with the polygonal recess;

a center of the polygonal body is provided with a shaft hole that passes through the polygonal body and the polygonal convex block;

the locking element is provided on an outer side of one of the outermost counterweight blocks on the main shafts, which restricts an axial movement of the outermost counterweight block.

3. The fitness equipment configured for weight adjustment according to claim 2, wherein each counterweight block of the counterweight blocks has three equal parts in an axial direction, a middle of the counterweight block occupies one equal part of the counterweight block, the polygonal convex block occupies one equal part of one side of the counterweight block, and the polygonal recess occupies one equal part of the other side of the counterweight block.

4. The fitness equipment configured for weight adjustment according to claim 3, wherein the three equal parts of each of the counterweight blocks are separate structures, which are connected as a whole through welding or bonding; or the three equal parts of each of the counterweight blocks form an integrated structure.

5. The fitness equipment configured for weight adjustment according to claim 2, wherein a central hole is provided on the handle;

two ends of the central hole are fixedly provided with nuts;

one end of each of the nuts is extended from an end face of the handle, and an external thread is provided on one end of a neck part of each of the main shafts;

polygonal holes of the limit blocks are sleeved with the nuts, screwed onto the nuts on the main shafts, and pressed onto the handle.

6. The fitness equipment configured for weight adjustment according to claim 2, wherein a drum shaped protrusion is provided in a middle of the handle.

7. The locking element according to claim 1, wherein an upper surface of the unlocking button is provided with one or more protrusions, a lower surface of the annular cover plate is provided with a guide groove that allows the one or more protrusions to move laterally;

the unlocking button is provided with inclined driving surfaces that drive the inclined surfaces to move axially to unlock.

8. The locking element according to claim 1, wherein a conical groove matching the first conical surface is provided on the inner wall of the outer sleeve cylinder, a conical ring is provided in the conical groove;

an inner wall surface of the conical ring has the second conical surface;

inner diameters of the first through holes on the inner cylinder are shrined near an inner surface of the inner cylinder, so that an inner diameter of the first through holes are smaller than outer diameters of the steel balls, so that the steel balls move radially out of the first through holes and do not enter into the axial through hole of the inner cylinder.

9. The locking element according to claim 1, wherein an axial groove is provided on the first conical surface between adjacent first through holes of the first through holes on the inner cylinder, and a hollow hole penetrating a side wall of the inner cylinder is provided on the first conical surface on an upper side of the first through holes.

10. The locking element according to claim 1, wherein an outer wall of a cylindrical body formed by shrinking of an upper outer wall of the inner cylinder is provided with two or more guide grooves, and an inner wall of the annular cover plate is provided with a guide block that is sleeved into the two or more guide grooves and cooperates with an axial movement of the inner cylinder.

11. The locking element according to claim 1, wherein an annular groove is provided on an upper surface of the annular cover plate;

bolt mounting holes are spaced apart in a circumferential direction around the annular groove;

the annular cover plate is screwed into threaded holes on the outer sleeve cylinder through the bolt mounting holes.

* * * * *